US006118411A

United States Patent [19]

Hasegawa et al.

[11] Patent Number: 6,118,411

[45] Date of Patent: Sep. 12, 2000

[54] LOOP ANTENNA AND ANTENNA HOLDER THEREFOR

[75] Inventors: Yu Hasegawa, Kanagawa; Nobutaka Mochizuki, Shizuoka; Kenichi Nishikawa, Kanagawa; Kazuhiro Ikeda; Syuuichi Sugawara, both of Miyagi, all of Japan

[73] Assignee: Matsushita Electric Industrial Co., Ltd., Osaka, Japan

[21] Appl. No.: 09/294,694

[22] Filed: Apr. 19, 1999

[30] Foreign Application Priority Data

Apr. 20, 1998 [JP] Japan ..... 10-123889

[51] Int. Cl.[7] ..... H01Q 11/12

[52] U.S. Cl. ..... 343/744; 343/702; 343/866

[58] Field of Search ..... 343/702, 741, 343/742, 743, 744, 748, 866, 867; H01Q 11/12

[56] References Cited

U.S. PATENT DOCUMENTS 5,300,938 4/1994 Maroun et al. ..... 343/702

5,451,965 9/1995 Matsumoto ..... 343/702

5,673,054 9/1997 Hama ..... 343/744

5,973,650 10/1999 Nakanishi ..... 343/744

*Primary Examiner*—Don Wong

*Assistant Examiner*—Hoang Nguyen

*Attorney, Agent, or Firm*—Pearne & Gordon LLP

[57] ABSTRACT

A closed loop is formed by loop antenna elements which equivalently function as inductance, a capacitor inserted in such a manner as to divide the loop antenna into the loop antenna elements, and an impedance-matching dividing element for tuning the antenna and establishing matching with a high-frequency circuit side. A subsidiary substrate with the capacitor mounted thereon is fixedly installed by a retaining pawl of an antenna holder, and is connected to the loop antenna elements by being soldered thereto at a pair of lands on the subsidiary substrate. As a result, it is possible to improve the effective gain of the antenna and effectively utilize the substrate space.

6 Claims, 3 Drawing Sheets

LOOP ANTENNA AND ANTENNA HOLDER THEREFOR

BACKGROUND OF THE INVENTION

1. Field of the Invention

The present invention relates to a loop antenna used for a portable compact receiver and an antenna holder therefor, and more particularly to a loop antenna having an antenna holder capable of installing and holding a subsidiary substrate with a capacitor mounted thereon.

2. Description of the Related Art

A portable compact receiver, particularly an individual selective calling receiver such as a pager, is normally carried by a user, so that the overall apparatus is made compact, a loop antenna which can be incorporated in the receiver is used as an antenna of that receiver, and an antenna holder is widely used as a holder for holding the loop antenna.

A conventional loop antenna is arranged such that, as its circuit diagram is shown in FIG. 4(*a*), a closed loop is formed by loop antenna elements 19 and 20 which equivalently function as inductance, a capacitor 4 inserted in such a manner as to divide the loop antenna into the loop antenna elements 19 and 20, and an impedance-matching dividing element 3 for tuning the antenna and establishing matching with a high-frequency circuit side. As its schematic diagram is shown in FIG. 4(*b*), the loop antenna elements 19 and 20 are fixedly held by an antenna holder 6, and the capacitor 4 and the impedance-matching dividing element 3 are mounted on a substrate 8 and are soldered to the loop antenna elements 19 and 20 at lands provided on the substrate 8.

With the above-described conventional loop antenna, there has been a problem in that it is impossible to obtain an intrinsic effective gain of the antenna due to the portion of loss resistance at the soldered portions of the capacitor 4 and the loop antenna elements 19 and 20 on the substrate 8.

In addition, individual selective calling receivers in recent years are increasingly becoming compact, and it is difficult to secure a mounting area. If the conventional antenna holder 6 is used, since the capacitor 4 is disposed on the substrate 8, the capacitor 4 must be soldered to the antenna elements 19 and 20 on the substrate 8, so that a large mounting space has been required.

SUMMARY OF THE INVENTION

The present invention has been devised to overcome the above-described problems, and its object is to provide a loop antenna which makes it possible to install and hold a subsidiary substrate with a capacitor mounted thereon as well as an antenna holder therefor, thereby making it possible to improve the effective gain of the antenna through a decrease in the portion of loss resistance and to effectively utilize the mounting space.

Accordingly, the loop antenna in accordance with the present invention is arranged such that a capacitor which is inserted by dividing a loop antenna element is installed and held in an antenna holder, and that the loop antenna element is installed and held in the antenna holder and is connected to the capacitor to divide the loop antenna element.

In addition, the antenna holder in accordance with the present invention is arranged such that a subsidiary substrate on which a capacitor inserted by dividing a loop antenna element is disposed is installed and held by providing the antenna holder with a retaining pawl making use of the resiliency of a resin, or by using pressure sensitive adhesive double coated tape.

In accordance with the present invention described above, advantages are offered in that it is possible to improve the effective gain of the antenna through a decrease in the portion of loss resistance and to effectively utilize a mounting space on a substrate.

According to a first aspect of the present invention, a loop antenna is arranged such that a capacitor which is inserted by dividing a loop antenna element is installed and held in an antenna holder, and that the loop antenna element is installed and held in the antenna holder and is connected to the capacitor to divide the loop antenna element. Accordingly, operation is exhibited such that it is possible to improve the effective gain of the antenna and effectively utilize the substrate space.

According to a second aspect of the present invention, a loop antenna is arranged such that a capacitor which is inserted by dividing a loop antenna element is mounted on a subsidiary substrate, that the subsidiary substrate is installed and held in an antenna holder, and that the loop antenna element is installed and held in the antenna holder and is connected to the capacitor on the subsidiary substrate to divide the loop antenna element. Accordingly, operation is exhibited such that it is possible to improve the effective gain of the antenna and effectively utilize the substrate space.

According to a third aspect of the present invention, an antenna holder is arranged such that a subsidiary substrate on which a capacitor inserted by dividing a loop antenna element is disposed is installed and held by providing the antenna holder with a retaining pawl making use of the resiliency of a resin, or by using pressure sensitive adhesive double coated tape. Accordingly, operation is exhibited such that it is possible to improve the effective gain of the antenna and effectively utilize the substrate space.

According to a fourth aspect of the present invention, an antenna holder is arranged such that a subsidiary substrate on which a capacitor inserted by dividing a loop antenna element is disposed is installed and held by means of a retaining pawl making use of the resiliency of a resin forming the antenna holder. Accordingly, operation is exhibited such that it is possible to improve the effective gain of the antenna and effectively utilize the substrate space.

According to a fifth aspect of the present invention, an antenna holder is arranged such that a subsidiary substrate on which a capacitor inserted by dividing a loop antenna element is disposed is installed and held by using pressure sensitive adhesive double coated tape. Accordingly, operation is exhibited such that it is possible to improve the effective gain of the antenna and effectively utilize the substrate space.

According to a sixth aspect of the present invention, the antenna holder according to claim 3 is arranged such that the subsidiary substrate is bonded to the antenna holder. Accordingly, operation is exhibited such that it is possible to improve the effective gain of the antenna and effectively utilize the substrate space.

As apparent from the foregoing description, the loop antenna and the antenna holder therefor in accordance with the present invention, since it is possible to install and hold the subsidiary substrate, on which the capacitor inserted by dividing a loop antenna element is disposed, by providing the antenna holder with the retaining pawl making use of the resiliency of a resin, or by using pressure sensitive adhesive double coated tape. Accordingly, advantages are offers in that it is possible to effectively utilize the substrate space and improve the effective gain of the antenna.

The present disclosure relates to the subject matter contained in Japanese patent application No. Hei. 10-123889 (filed on Apr. 20, 1998) which is expressly incorporated herein by reference in its entirely.

BRIEF DESCRIPTION OF THE DRAWINGS

FIG. 1(*b*) is a view taken in the direction of arrow 1B in FIG. 1(*a*), and illustrates a state in which a subsidiary substrate is separate before it is installed on an antenna holder;

FIG. 1(*c*) is a cross-sectional view taken along line 1C—1C of FIG. 1(*a*);

FIG. 3(*b*) is a view taken in the direction of arrow 3B in FIG. 3(*a*), and illustrates a state in which the subsidiary substrate is separate before it is installed on the antenna holder;

FIG. 3(*c*) is a cross-sectional view taken along line 3C—3C of FIG. 3(*a*);

FIG. 4(*b*) is a schematic diagram of the conventional loop antenna.

DETAILED DESCRIPTION OF THE PREFERRED EMBODIMENTS

Figure 1A:
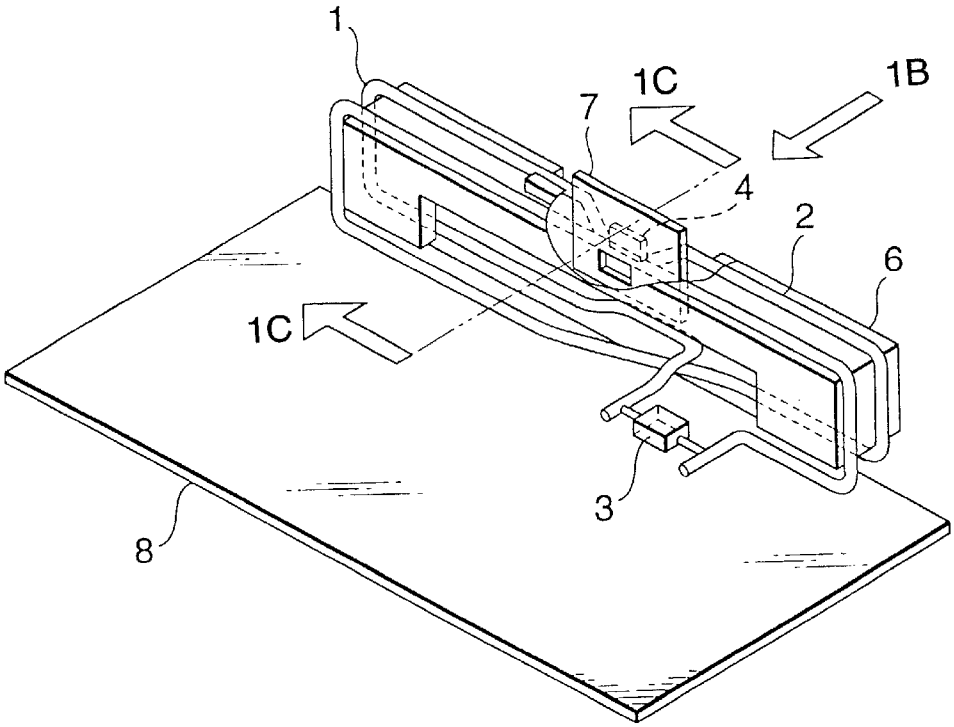
FIG. 1(*a*) is a perspective view illustrating the configuration of a loop antenna in accordance with a first embodiment of the present invention.
Figure 1B:
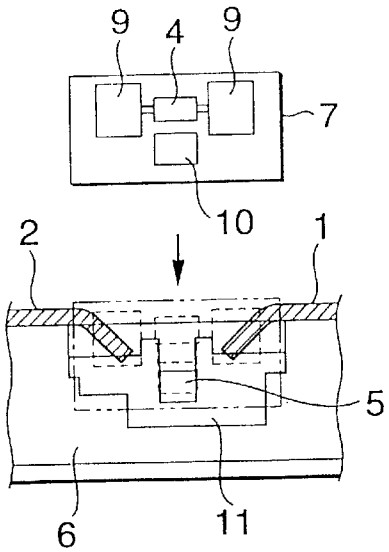
Figure 1C:
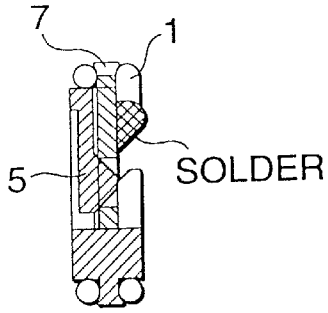
Figure 2:
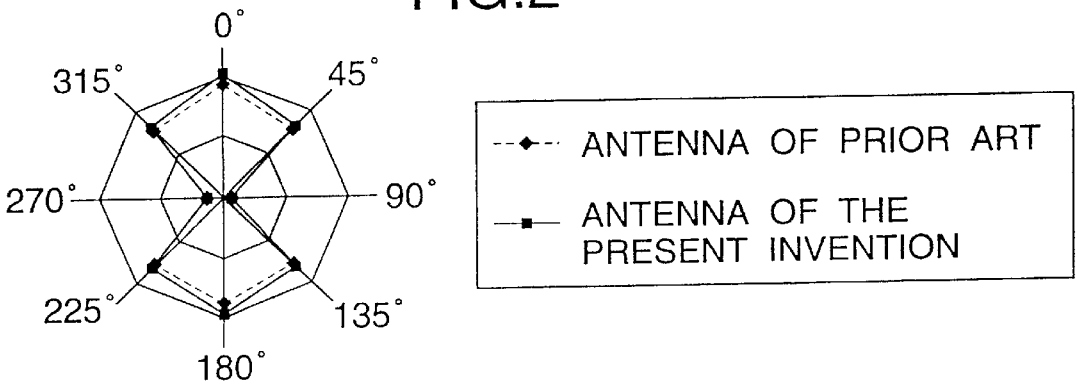
FIG. 2 is a diagram illustrating directional patterns of antennas in accordance with the first and second embodiments of the present invention.
Figure 3A:
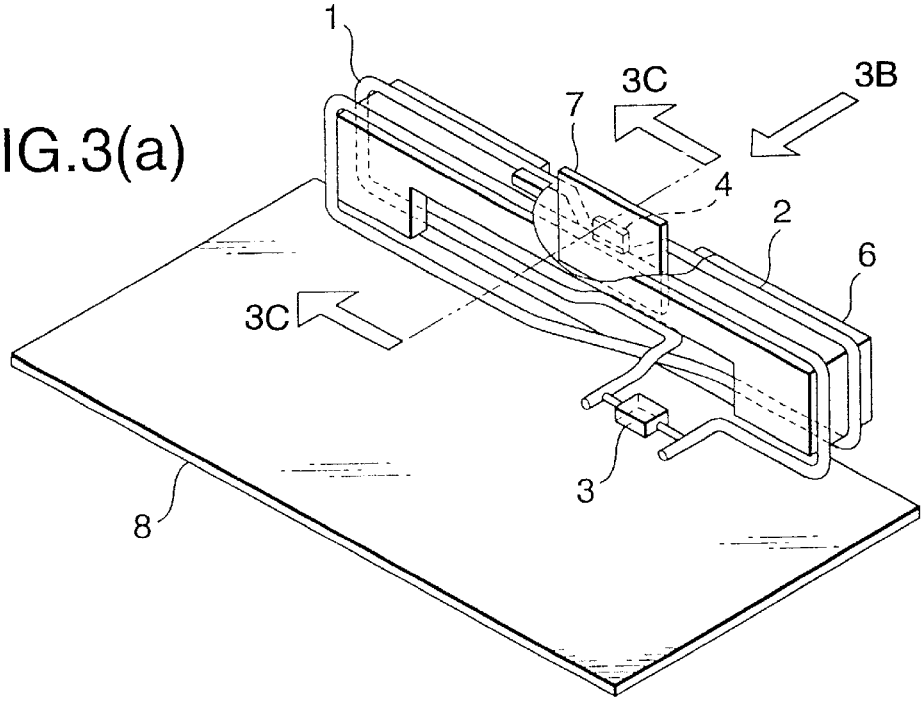
FIG. 3(*a*) is a perspective view illustrating the configuration of a loop antenna in accordance with a second embodiment of the present invention.
Figure 3B:
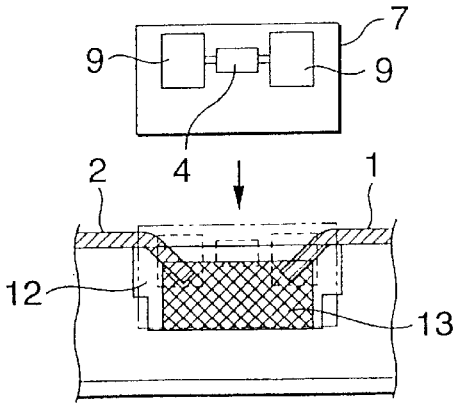
Figure 3C:
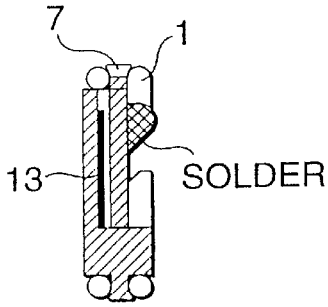
Figure 4A:
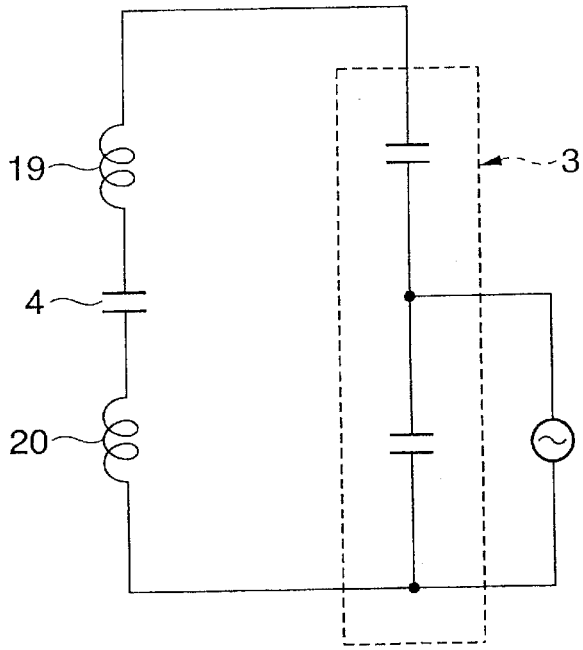
FIG. 4(a) PRIOR ART
FIG. 4(*a*) is an equivalent circuit diagram of a conventional loop antenna.
Figure 4B:
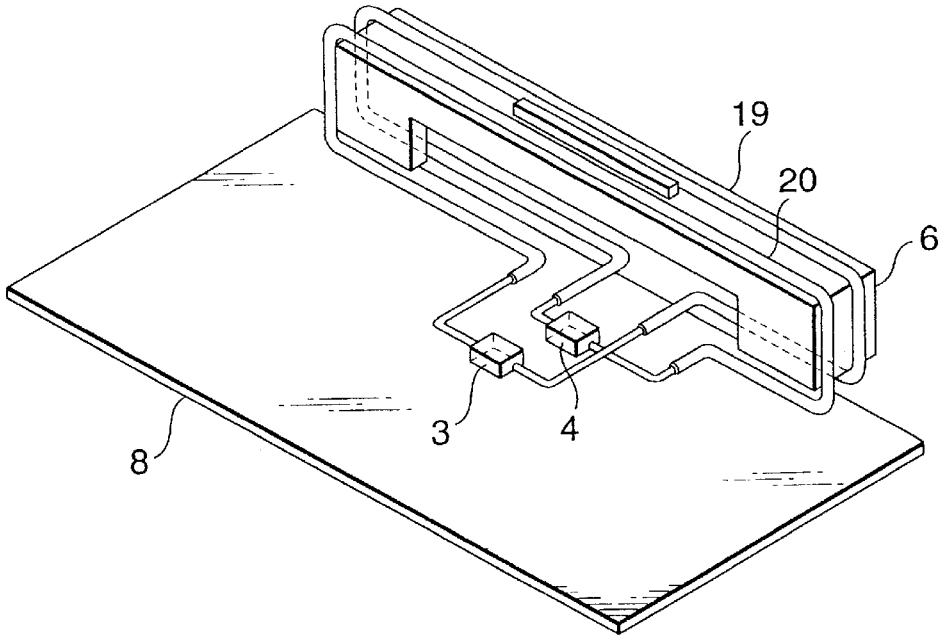
FIG. 4(b) PRIOR ART

Referring now to FIGS. 1 to 3, a description will be given of the embodiments of the present invention.

[First Embodiment]

In a first embodiment of the present invention, as is apparent from a perspective view illustrating the configuration of a loop antenna in FIG. 1(*a*), a closed loop is formed by loop antenna elements 1 and 2 which equivalently function as inductance, a capacitor 4 inserted in such a manner as to divide the loop antenna into the loop antenna elements 1 and 2, and an impedance-matching dividing element 3 for tuning the antenna and establishing matching with a high-frequency circuit side.

A subsidiary substrate 7 with the capacitor 4 mounted thereon is fixedly installed by a retaining pawl 5 of an antenna holder 6, and is connected to the loop antenna elements 1 and 2 by being soldered thereto at a pair of lands 9 on the subsidiary substrate 7.

It should be noted that the retaining pawl 5 is formed integrally at the time of formation of the antenna holder, and its material is formed of a resin.

In addition, FIG. 1(*b*) is a view taken in the direction of arrow 1B in FIG. 1(*a*), and illustrates a state in which the subsidiary substrate 7 is separate before it is installed on the antenna holder 6. The capacitor 4 and the lands 9 which are respectively connected electrically to both sides of the capacitor 4 are provided on the subsidiary substrate 7, and a retaining hole 10 in which the pawl 5 of the antenna holder 6 is retained is formed below the capacitor 4. A hole 11 is formed in the antenna holder 6, and the pawl 5 is provided in such a manner as to be resiliently deformable in a cantilevered manner.

The positional relationship among the pawl 5, the subsidiary substrate 7, and the loop antenna elements 1 and 2 is shown in FIG. 1(*c*) which is a cross-sectional view taken along line 1c—1C of FIG. 1(*a*), and a space into which the subsidiary substrate 7 is inserted is provided between the pawl 5 and the loop antenna elements 1 and 2. The structure is provided such that if the subsidiary substrate 7 is inserted into the space, the subsidiary substrate 7 is clamped by the pawl 5 and the loop antenna elements 1 and 2.

If the subsidiary substrate 7 is inserted in the direction of arrow in FIG. 1(*b*), the pawl 5 is fitted in the retaining hole 10 in the subsidiary substrate 7, and is thereby positioned. Then, portions where the two lands 9 and the tips of the loop antenna elements 1 and 2 abut against each other are soldered, as shown in FIG. 1(*c*).

FIG. 2 shows directional patterns of the antennas. In the configuration of the antenna in the present invention, a portion of the pattern-shaped antenna loop is formed by the capacitor on the subsidiary substrate, and the portion of loss resistance is reduced since the structure is simple as compared with the structure of the conventional antenna, and since the induction of current radiation to a neighboring object at the capacitor portion in the conventional antenna configuration is eliminated. the effective gain of the antenna is improved by 0.5 dB or thereabouts over the entire region as compared with the loop antenna of the conventional configuration.

As described above, in accordance with the first embodiment, advantages are offered in that the effective gain of the antenna is improved, and that the substrate space can be effectively utilized.

[Second Embodiment]

In a second embodiment of the present invention, as is apparent from a perspective view illustrating the configuration of a loop antenna in FIG. 3(*a*), a closed loop is formed by the loop antenna elements 1 and 2 which equivalently function as inductance, the capacitor 4 inserted in such a manner as to divide the loop antenna into the loop antenna elements 1 and 2, and the impedance-matching dividing element 3 for tuning the antenna and establishing matching with a high-frequency circuit side. The subsidiary substrate 7 with the capacitor 4 mounted thereon is fixedly installed on the antenna holder 6 by adhesive means such as pressure sensitive adhesive double coated tape 13 or bonding means, and is connected to the loop antenna elements 1 and 2 by being soldered thereto at the pair of lands 9 on the subsidiary substrate 7.

In addition, FIG. 3(*b*) is a view taken in the direction of arrow 3B in FIG. 3(*a*), and illustrates a state in which the subsidiary substrate 7 is separate before it is installed on the antenna holder 6. The capacitor 4 and the lands 9 which are respectively connected electrically to both sides of the capacitor 4 are provided on the subsidiary substrate 7. The antenna holder 6 is provided with a recessed portion 12, and the pressure sensitive adhesive double coated tape 13 is attached thereto.

The positional relationship among the pressure sensitive adhesive double coated tape 13, the subsidiary substrate 7, and the loop antenna elements 1 and 2 is shown in FIG. 3(*c*) which is a cross-sectional view taken along line 3C—3C of FIG. 3(*a*), and a space into which the subsidiary substrate 7 is inserted is provided between the pressure sensitive adhesive double coated tape 13 attached to the recessed portion 12 of the antenna holder 6 and the loop antenna elements 1 and 2. The structure is provided such that if the subsidiary substrate 7 is inserted into the space, the subsidiary substrate 7 is clamped by the pressure sensitive adhesive double coated tape 13 and the loop antenna elements 1 and 2.

If the subsidiary substrate 7 is inserted in the direction of arrow in FIG. 3(*b*) and is pressed against and attached to the pressure sensitive adhesive double coated tape 13, positioning is effected. Then, portions where the two lands 9 and the tips of the loop antenna elements 1 and 2 abut against each other are soldered, as shown in FIG. 3(*c*).

As described above, in accordance with the second embodiment as well, in the same way as in the first embodiment shown in FIG. 1 advantages are offered in that the effective gain of the antenna is improved, and that the substrate space can be effectively utilized.

Although an arrangement has been shown in which the subsidiary substrate 7 is installed as a separate part from the antenna holder 6, the subsidiary substrate 7 and the antenna 6 may be formed in advance as a unit component part by forming the subsidiary substrate 7 in a large size to allow the subsidiary substrate 7 to also function as the antenna holder 6. In addition, although an example has been shown in which the tips of the loop antenna elements 1 and 2 and the lands 9 on the subsidiary substrate are soldered, an arrangement may be adopted in which the space into which the subsidiary substrate is inserted is formed in advance in a small size, and if the subsidiary substrate is inserted, the tips of the loop antenna elements 1 and 2 are brought into pressure contact with the lands 9 on the subsidiary substrate in such a manner as to cause the tips of the loop antenna elements 1 and 2 to be pressed in a spreading manner by the lands 9 on the subsidiary substrate, thereby omitting the soldering.

What is claimed is:

1. A loop antenna comprising:

first and second loop antenna elements;

an antenna holder; and, a capacitor, wherein said capacitor is held in said antenna holder and serves to connect said first loop antenna element with said second loop antenna element, and wherein said first and second loop antenna elements together with said capacitor are installed and held in said antenna holder.

2. A loop antenna comprising:

first and second loop antenna elements;

an antenna holder;

a subsidiary substrate, said subsidiary substrate being installed and held in said antenna holder; and, a capacitor, said capacitor connecting said first loop antenna element to said second loop antenna element, said capacitor being mounted on said subsidiary substrate;

said loop antenna elements being installed and held in said antenna holder and connected to said capacitor on said subsidiary substrate.

3. An antenna holder comprising:

a subsidiary substrate having a capacitor mounted thereon, said capacitor being inserted between and connecting portions of a loop antenna element, said subsidiary substrate being installed and held in place by cooperation of a retaining pawl and associated aperture, one of said pawl and aperture being provided by said subsidiary substrate and the other of said pawl and aperture being provided by said antenna holder.

4. The antenna holder according to claim 3, wherein said subsidiary substrate is bonded to said antenna holder.

5. An antenna holder comprising:

a subsidiary substrate having a capacitor mounted thereto, said capacitor being inserted between and connecting portions of a loop antenna, wherein said subsidiary substrate is installed and held in place by a retaining pawl making use of the resiliency of a resin forming said antenna holder.

6. An antenna holder comprising:

a subsidiary substrate having a capacitor mounted thereto, said capacitor being inserted between and connecting portions of a loop antenna, wherein said subsidiary substrate is installed and held in place by pressure sensitive adhesive double coated tape.

* * * * *